US005943892A

United States Patent [19]

Hoshi et al.

[11] Patent Number: 5,943,892

[45] Date of Patent: Aug. 31, 1999

[54] METHOD OF BREAKDOWN-FORMING ELECTRO-UNITE TUBES

[75] Inventors: Kiyomasa Hoshi, Nagoya; Kenichi Harano, Tokai, both of Japan

[73] Assignee: Sanyo Seiki Co., Ltd., Saitama-ken, Japan

[21] Appl. No.: 09/133,776

[22] Filed: Aug. 12, 1998

[30] Foreign Application Priority Data

Sep. 1, 1997 [JP] Japan ..... 9-236178

[51] Int. Cl.[6] ..... B21D 5/14; B21D 51/28

[52] U.S. Cl. ..... 72/52; 72/182; 72/181

[58] Field of Search ..... 72/51, 52, 178, 72/181, 182, 176, 179; 492/1, 30

[56] References Cited

U.S. PATENT DOCUMENTS

| | | | |
|---|---|---|---|
| 2,146,223 | 2/1939 | Penkala | 72/181 |
| 3,181,333 | 5/1965 | Hall | 72/240 |
| 3,550,235 | 12/1970 | Jarvis et al. | 72/181 |

FOREIGN PATENT DOCUMENTS

| | | | |
|---|---|---|---|
| 61-1423 | 1/1986 | Japan | 72/52 |

*Primary Examiner*—Rodney Butler

*Attorney, Agent, or Firm*—Fattibene & Fattibene; Paul A. Fattibene; Arthur T. Fattibene

[57] ABSTRACT

Electro-unite tubes having different plate thicknesses or different diameters are breakdown-formed without changing the upper rolls and the lower rolls of the breakdown pass rolls each time. Each of breakdown pass rolls 12 includes an upper roll 12*a* having a convex curved surface and a lower roll 12*b* opposed to the upper roll 12*a*, the lower roll 12*b* being provided with a V-shaped concave portion 13. A gap is maintained between a metal band plate 11 and the deepest portion D in the concave portion 13, and the metal band plate 11 is in local contact with the lower roll 12*b*. The upper roll 12*a* can be moved up and down, and the distance between the end of the curved surface of the upper roll 12*a* and the deepest portion D in the concave portion 13 is adjusted depending upon the plate thickness and the diameter of the electro-unite tube to determine the curvature ($R_1$ or $R_2$) for forming the metal band plate 11.

12 Claims, 8 Drawing Sheets

METHOD OF BREAKDOWN-FORMING ELECTRO-UNITE TUBES

BACKGROUND OF THE INVENTION

1. Field of the Invention

The present invention relates to a method of breakdown formation which is an initial step for forming an electro-unite tube. Particularly, the invention relates to a method of breakdown formation for forming a metal band plate by using breakdown pass rolls and forming both side portions thereof into an arcuate shape.

2. Prior Art

FIG. 6 illustrates a step of forming an electro-unite tube, in which a metal band plate 1 is formed into an arcuate shape at its both side portions through a series of breakdown pass rolls 2, and is, then, gradually formed into a circular shape in cross section through fin pass rolls 3. Finally, both edges are abutted together through squeeze rolls (not shown) and are welded together by electric resistance heating.

FIG. 7 illustrates a conventional breakdown pass roll 2, wherein the circumferential surface of an upper roll 2*a* includes flat central surfaces and convex curved surfaces at both the right and left side portions thereof. The circumferential surface of a lower roll 2*b* is symmetrical to the circumferential surface of the upper roll 2*a* and includes flat central portions, and concave curved surfaces at both the right and left side portions. A metal band plate 1 is held between the upper roll 2*a* and the lower roll 2*b,* and both side portions thereof are formed in an arcuate shape.

FIG. 8 illustrates another conventional breakdown pass roll 2, in which the upper right and left rolls 2*c*, 2*c* are provided being spaced apart from each other, and the circumferential surface of the lower roll 2*d* includes concave portions formed in both the right and left side portions thereof so as to meet the curved surfaces of the upper rolls 2*c,* and a slightly convex curved surface at the central portion thereof. The metal band plate 1 is held between the upper rolls 2*c* and the lower roll 2*d,* and is formed into an arcuate shape at both side portions thereof.

In the conventional breakdown pass roll, the concave portion is formed in the lower roll to meet the convex curved surface of the upper roll, and the metal band plate is held between the upper roll and the lower roll being intimately adhered thereto. With the combination of the same upper roll and the same lower roll, therefore, both side portions of a metal band plate are formed into an arcuate shape maintaining the same curvature. When it is attempted to mold an electro-unite tube having a different plate thickness or a different diameter, therefore, there must be employed a combination of another upper roll and another lower roll. Besides, the metal band plate is molded at a forming portion in a state of being intimately adhered to the upper roll and the lower roll at all times, resulting in the occurrence of hardening due to working and adversely affecting the quality of the electro-unite tube.

In forming the electro-unite tubes having different plate thicknesses and diameters, therefore, there arises a technical problem that must be solved so that the breakdown formation can be accomplished without the need of changing the combination of the upper roll and the lower roll each time. The object of the present invention is to solve this problem.

SUMMARY OF THE INVENTION

The present invention was proposed to accomplish the above-mentioned object, and is concerned with a method of breakdown-forming electro-unite tubes wherein in a step of breakdown-forming an electro-unite tube by arcuately forming both side portions of a metal band plate relying upon the breakdown pass rolls, each of said breakdown pass rolls includes an upper roll having a convex curved surface and a lower roll having a V-shaped concave portion opposed to said upper roll, and both side portions of the metal band plate are held between said upper rolls and said lower rolls and are formed into an arcuate shape.

The invention is further concerned with a method of breakdown-forming electro-unite tubes wherein said upper rolls and said lower rolls of said breakdown pass rolls are allowed to freely rotate, the distance is adjustable between the end of the curved surface of said upper roll and the V-shaped concave portion of said lower roll, and a pair of feed rolls are arranged in front of, or at the back of, said breakdown pass rolls.

DETAILED DESCRIPTION OF THE PREFERRED EMBODIMENTS

Figure 1:
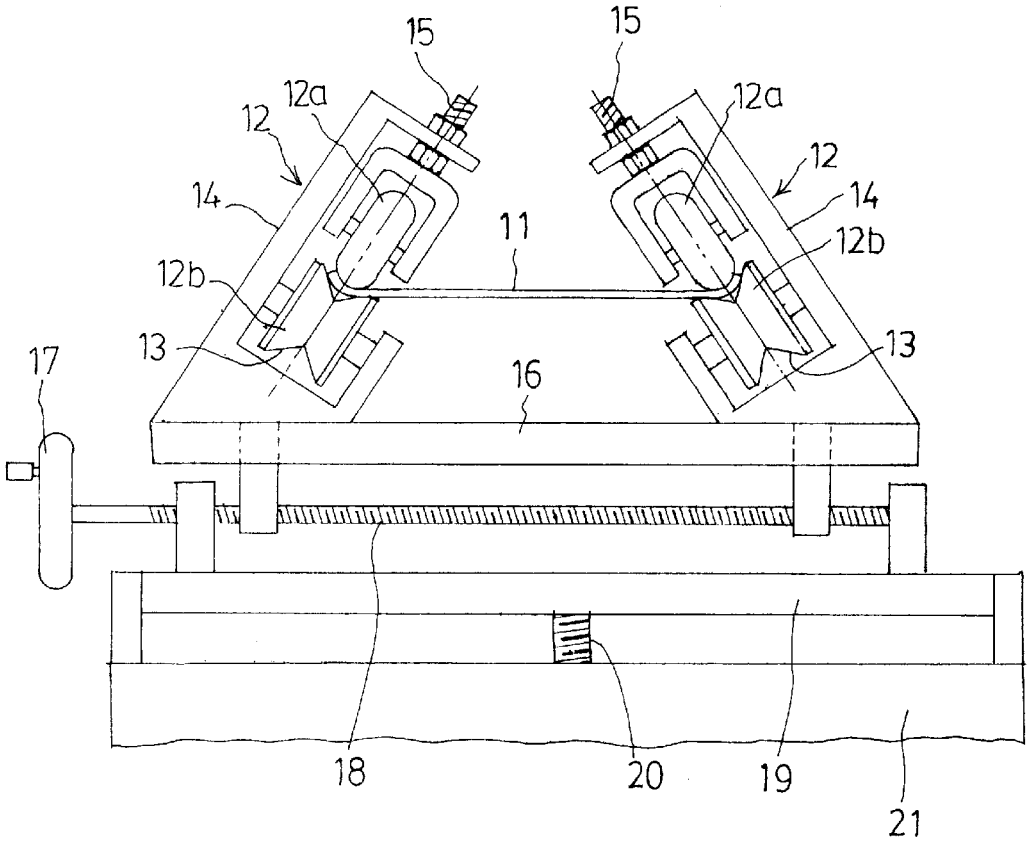
FIG. 1 is a front view of a first breakdown pass roll according to an embodiment of the present invention.

Embodiments of the invention will now be described in detail with reference to the drawings. FIG. 1 illustrates a first breakdown pass roll in a step of breakdown-forming an electro-unite tube, wherein each of breakdown pass rolls 12 symmetrically arranged on the right and left sides near both side portions of a metal band plate 11, includes an upper roll 12*a* having a convex curved surface and a lower roll 12*b* opposed to the upper roll 12*a,* the lower roll 12*b* having a V-shaped concave portion 13.

The breakdown pass rolls 12 are mounted on a frame 14, and the upper roll 12*a* can be moved up and down by adjusting a raise/lower screw 15. The right and left frames 14, 14 are mounted on a slide bar 16 so as to be slid in the right-and-left direction. By turning a screw rod 18 by operating a handle 17, the right and left frames 14, 14 can be brought close to each other or can be separated away from each other, making it possible to lengthen or shorten the distance between the right and left breakdown pass rolls 12 and 12. Moreover, the support frame 19 supporting the right and left frames 14 and the slide bar 16, can be finely adjusted for its height from a base plate 21 by adjusting a raise/lower screw 20.

Here, both side portions of the metal band plate 11 which is a material to be formed is held between the upper rolls 12*a* and the lower rolls 12*b*, and are formed into arcuate shapes. The shape of formation can be varied depending upon the amount of pushing the upper roll 12*a* and the angle of the concave portion 13 of the lower roll 12*b*, and the amount of pushing is adjusted to meet the plate thickness or diameter of the electro-unite tube that is to be formed. Here, the center line of the upper roll 12*a* in the direction of width has been brought into agreement with the center line of the lower roll 12*b* in the direction of width.

Figure 2A:
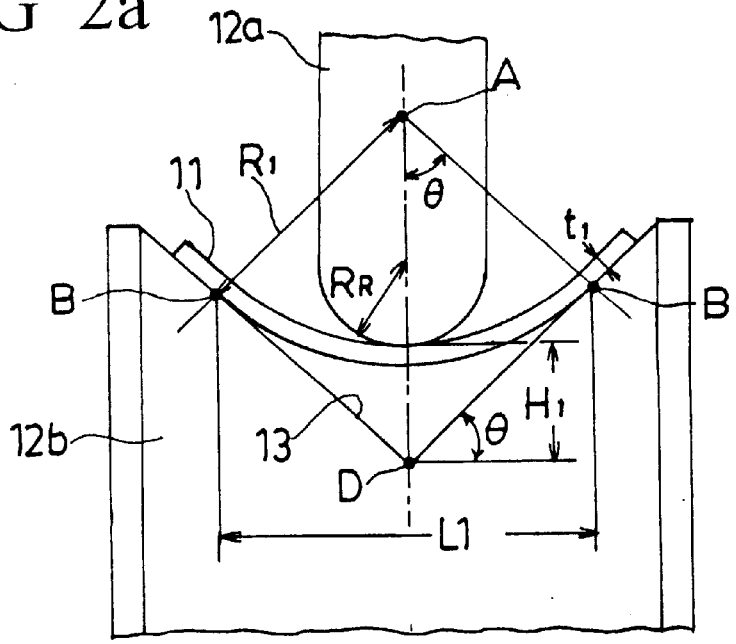
FIG. 2 is a diagram illustrating the principle of a method of breakdown formation of the present invention, wherein FIG. 2(*a*) illustrates the breakdown formation of an electro-unite tube of a large diameter.
FIG. 2(b) illustrates the breakdown formation of an electro-unite tube of a small diameter.
Figure 2B:
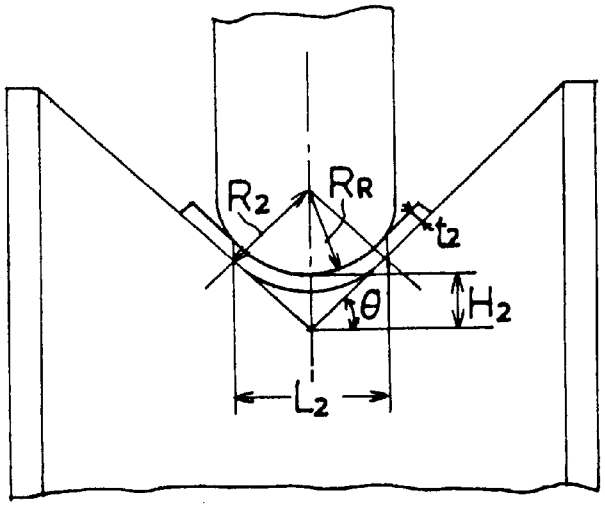

Next, described below with reference to FIG. 2 is the principle of the method of breakdown formation according to the present invention. As described above, the lower roll 12*b* is provided with the V-shaped concave portion 13, a gap is maintained between the metal band plate 11 and the deepest portion D of the concave portion 13, and the metal band plate 11 is brought into local contact with the lower roll 12*b*. As described above, the upper roll 12*a* can be moved up and down, and the distance can be adjusted between the end of the curved surface of the upper roll 12*a* and the deepest portion D of the concave portion 13, i.e., the pushing amount of the upper roll 12*a* can be adjusted.

FIG. 2(*a*) illustrates breakdown formation of an electro-unite tube of a large diameter. Here, when the thickness of the metal band plate 11 is denoted by $t_1$, the distance from the center A of curvature for forming the metal band plate 11 to a point B of contact to the lower roll 12*b* is denoted by $R_1$, i.e., the radius of curvature by $R_1$, and the angle of inclination of the concave portion 13 to the axial direction by θ, then, the distance $L_1$ between the points B and B where the metal band plate 11 is in contact with the lower rolls 12*b*, and the pushing amount $H_1$ of the upper rolls 12*a* are given by the following formulas.

At a point B where the metal band plate 11 is in contact with the lower roll 12*b*, the tilted surface of the concave portion 13 is positioned on a tangential line of the radius of forming curvature $R_1$. Therefore, a segment AB is at right angles with a segment BD. Furthermore, an angle subtended by the segment AB and a segment AD is equal to an angle of inclination θ of the concave portion 13 with respect to the axial direction.

Therefore, $$L_1=(R_{12}\times\sin\theta)\times 2 \tag{1}$$

When the distance between A and D is denoted by X, then, $$X=R_1/(\cos\theta)$$

$$H_1=X-R_1+t_1$$

$$\therefore H_1=R_1/(\cos\theta)-R_1+t_1 \tag{2}$$

That is, the curvature $R_1$ for forming the metal band plate 11 is determined by the distance $L_1$ between the points B and B where the metal band plate 11 is in contact with the lower rolls 12*b* and by the pushing amount $H_1$ of the upper rolls 12*a*. The convex curved surface of the upper roll 12*a* has a radius of curvature $R_R$.

FIG. 2(*b*) illustrates the breakdown formation of the electro-unite tube of a small diameter. Here, when the thickness of the metal band plate 11 is denoted by $t_2$, the radius of curvature for forming the metal band plate 11 by $R_2$, and the angle of inclination of the concave portion 13 to the axial direction by θ, then, the distance $L_2$ between the points B and B where the metal band plate 11 is in contact with the lower rolls 12*b*, and the pushing amount $H_2$ of the upper rolls 12*a* are given by the following formulas.

$$L_2=(R_2\times\sin\theta)\times 2 \tag{3}$$

$$H_2=R_2/(\cos\theta)-R_2+t_2 \tag{4}$$

Upon changing the pushing amount ($H_1$ or $H_2$) of the upper roll 12*a* and the distance ($L_1$ or $L_2$) between the points B and B where the metal band plate 11 is in contact with the lower rolls 12*b* to meet the plate thickness and the diameter of the electro-unite tube that is to be formed, it is allowed to breakdown-form the electro-unite tubes having different plate thicknesses and diameters relying on the combination of the same upper rolls 12*a* and the same lower rolls 12*b*. Thus, both end portions of the flat metal band plate 11 can be formed into an arcuate shape by the first breakdown pass rolls 12 shown in FIG. 1.

Figure 3:
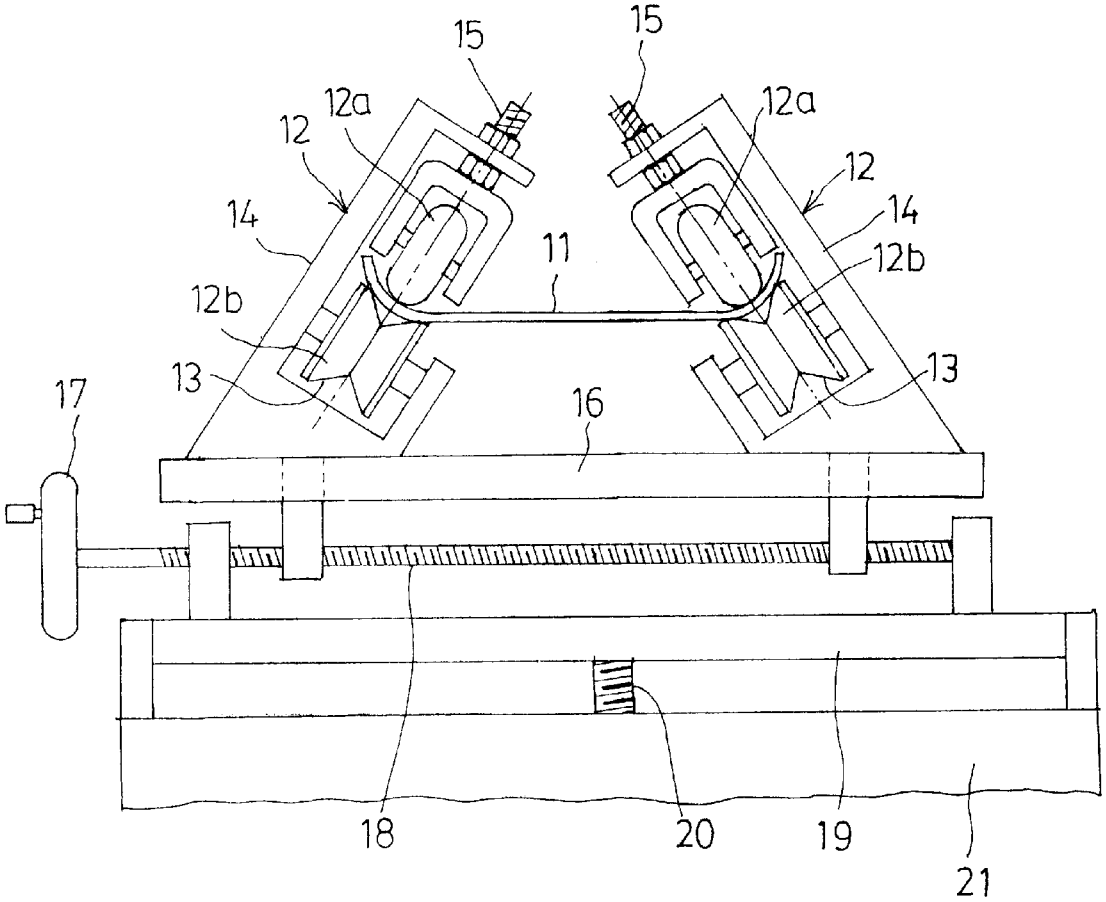
FIG. 3 is a front view of a second breakdown pass roll according to the embodiment of the present invention.

Thereafter, the portions slightly on the inner sides of both ends of the metal band plate 11 are arcuately formed through the same step as the one mentioned above by the second breakdown pass rolls 12 shown in FIG. 3. The width for installing the second breakdown pass rolls 12 in the right-and-left direction is narrower than the width for installing the first breakdown pass rolls 12 in the right-and-left direction, and the distance between the points B and B where the metal band plate 11 comes in contact with the lower rolls 12*b* and the pushing amount of the upper rolls 12*a* are suitably adjusted to meet the radius of curvature of the second breakdown formation.

When the electro-unite tube has a different plate thickness or a different diameter, the pushing amount of the upper rolls 12*a* is changed to adjust the distance between the points B and B where the metal band plate 11 comes into contact with the lower rolls 12*b*. It is, however, further allowable to exchange the upper rolls 12*a* to change the radius of convex curvature $R_R$ or to exchange the lower rolls 12*b* to change the angle θ of inclination of the concave portion 13 relative to the axial direction, in order to form a curved surface having a predetermined radius of curvature.

Figure 4:
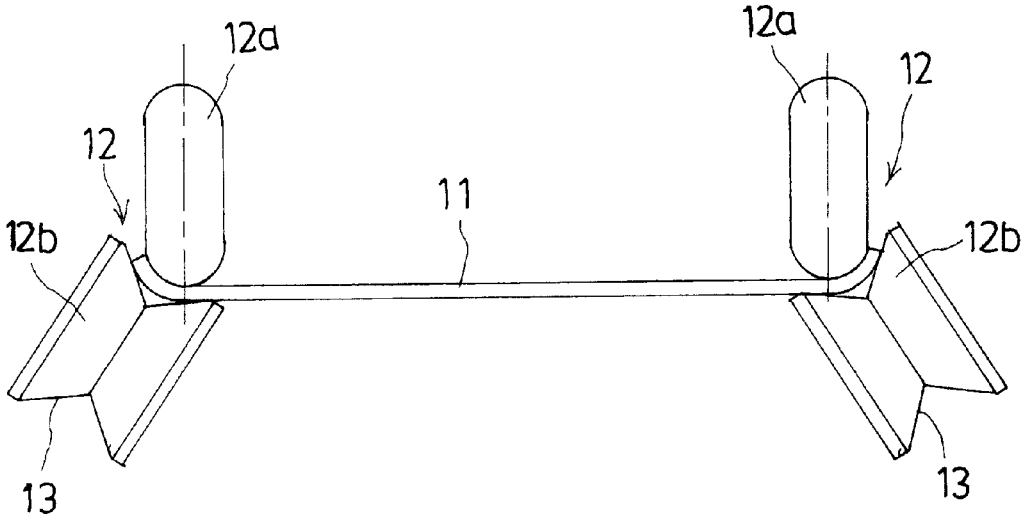
FIG. 4 is a front view of the breakdown pass roll according to another embodiment of the present invention.
Figure 5A:
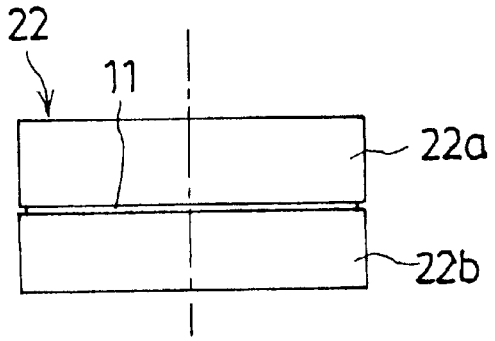
FIG. 5 is a diagram illustrating the arrangement of rolls in a step of breakdown formation according to the present invention, wherein FIG. 5(*a*) illustrates first feed rolls, FIG. 5(*b*) illustrates first breakdown pass rolls, FIG. 5(*c*) illustrates second feed rolls, and FIG. 5(*d*) illustrates second breakdown pass rolls.
Figure 5B:
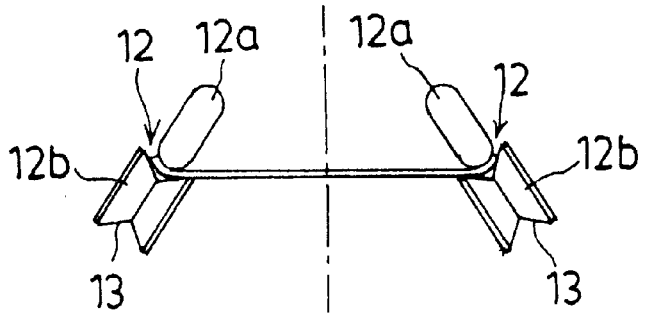
Figure 5C:
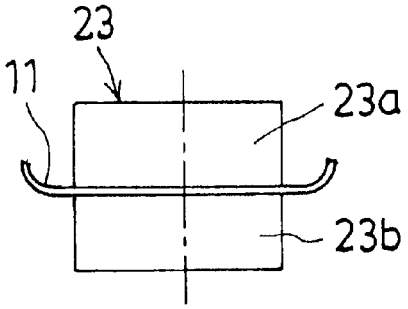
Figure 5D:
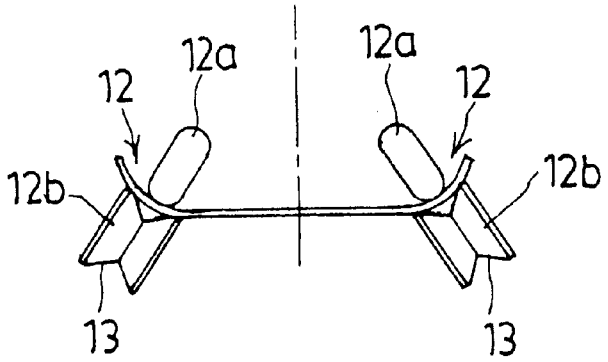
Figure 6:
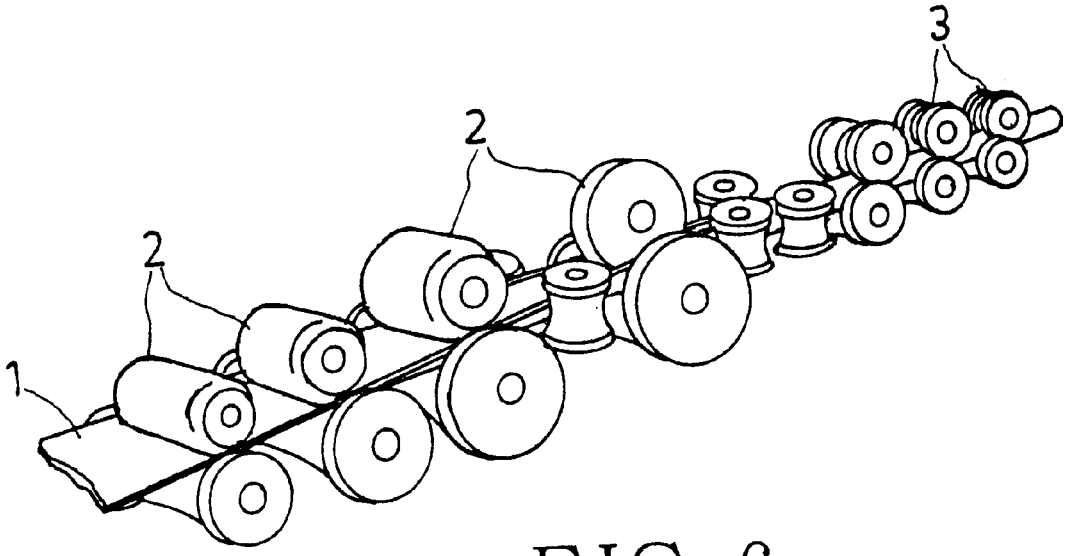
FIG 6 (Prior Art)
FIG. 6 is a diagram illustrating a conventional step of forming an electro-unite tube.
Figure 7:
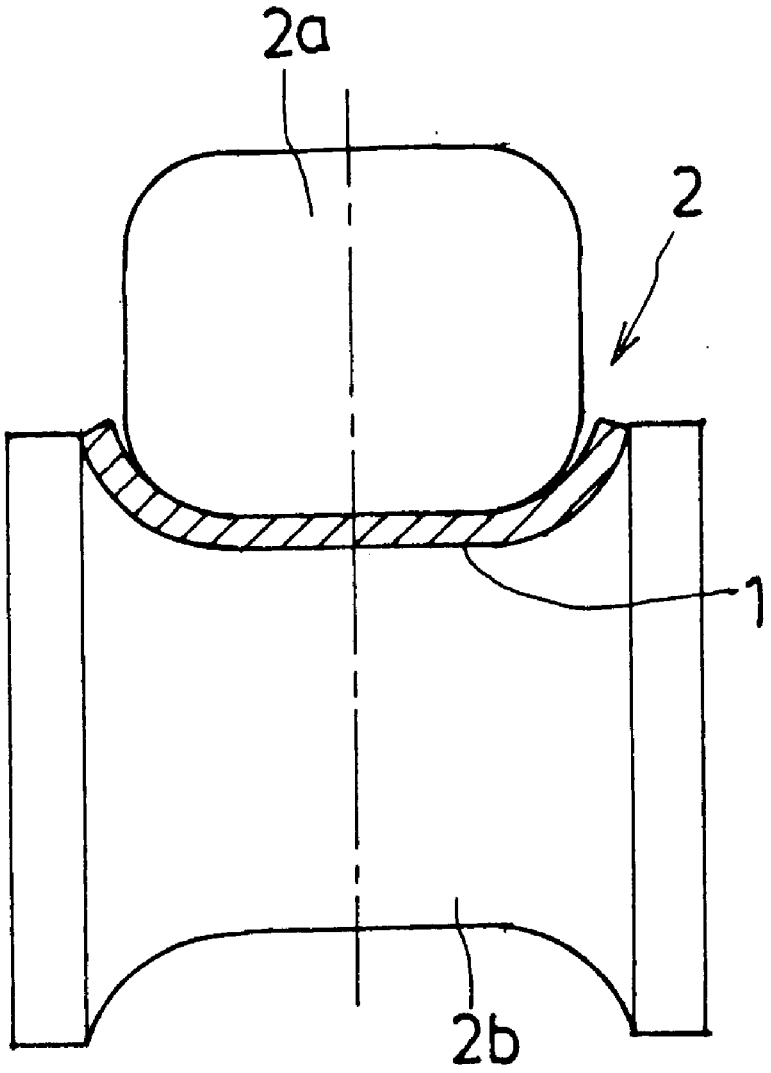
FIG 7 (Prior Art)
FIG. 7 is a front view illustrating a conventional breakdown pass roll.
Figure 8:
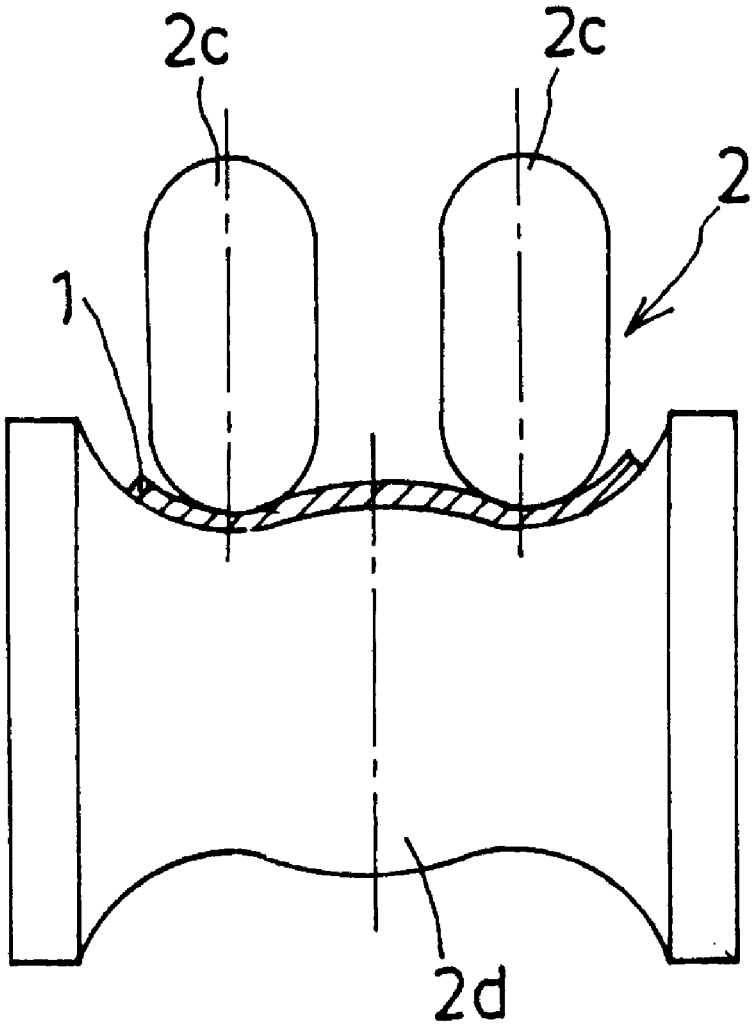
FIG 8 (Prior Art)
FIG. 8 is a front view illustrating another conventional breakdown pass roll.

As shown in FIG. 4, furthermore, the center lines of the upper rolls 12*a* in the direction of width are not brought into agreement with the center lines of the lower rolls 12*b* in the direction of width, and the angles of rotational surfaces of the upper rolls 12*a* may be offset with respect to the angles of the rotational surfaces of the lower rolls 12*b*. In the case of this constitution, too, the radius of curvature for forming the metal band plate 11 can be arbitrarily adjusted by moving the upper rolls 12*a* up and down or right and left.

FIG. 5 illustrates an arrangement of the rolls in the step of breakdown formation. Referring to FIG. 5(*a*), the metal band plate 11 which is the material to be formed is fed backward being held by a pair of upper and lower feed rolls 22. The feed rolls 22 include an upper roll 22*a* and a lower roll 22*b* having nearly the same width as the metal band plate 11 and are driven by a motor (not shown). Then, as shown in FIG. 5(*b*), both side portions of the flat metal band plate 11 are arcuately formed by the first breakdown pass rolls 12. The breakdown pass rolls 12 are not driven by motor, and both the upper rolls 12*a* and the lower rolls 12*b* are allowed to freely rotate. Referring, next, to FIG. 5(*c*), a pair of upper and lower feed rolls 23 are provided at the back of the first breakdown pass rolls 12. The feed rolls 23 include an upper roll 23*a* and a lower roll 23*b* having a width narrower than the above-mentioned feed rolls 22 to hold a portion on the insides of both ends of the metal band plate 11 that is arcuately formed. The rolls are driven by the motor, too. Then, as shown in FIG. 5(*d*), the portions slightly on the inner side of both ends of the metal band plate 11 are arcuately formed by the second breakdown pass rolls 12. The breakdown pass rolls 12 are not driven by motor, either, and the upper rolls 12*a* and the lower rolls 12*b* are allowed to freely rotate.

Thus, the feed rolls driven by the motor are arranged in front of, or at the back of, the breakdown pass rolls 12 to effect the breakdown formation a plural number of times. Thereafter, the metal band plate 11 is formed into a circular shape in cross section by fin pass rolls (not shown) and, finally, both edges are abutted together by squeeze rolls (not shown) and are welded together by electric resistance heating.

Though not diagramed, the upper rolls 12*a* and the lower rolls 12*b* may be arranged in a plural number to breakdown-form not only circular steel tubes but also polygonal steel tubes and groove-shaped steel tubes. By driving the lower rolls 12*b* of the breakdown pass rolls 12 by a motor, furthermore, the feed rolls 22 and 23 may be omitted.

According to the invention of a preferred embodiment as described above, the upper rolls having a convex curved surface and lower rolls having a V-shaped concave portion are arranged being opposed to each other to constitute breakdown pass rolls, and both side portions of a metal band plate are held between the upper rolls and the lower rolls and are arcuately formed. In the forming portion, therefore, the metal band plate come into local contact with the upper and lower rolls, and the metal band plate is not intimately adhered to the upper and lower rolls at all times. Therefore, the breakdown formation is accomplished requiring a decreased force, which contributes to saving energy. Besides, the occurrence of scars due to the rolling is suppressed and the hardening is caused less by the working.

According to the invention of a preferred embodiment, it is allowed to adjust the distance between the upper roll and the lower roll of the breakdown pass roll. Therefore, even when the electro-unite tube has a different plate thickness or a different diameter, the distance between the upper roll and the lower roll is adjusted to arbitrarily change the radius of curvature for the formation making it possible to greatly enhance the operation efficiency of the breakdown formation. Moreover, a pair of feed rolls are arranged in front of, or at the back of, the breakdown pass rolls, and the upper rolls and the lower rolls are allowed to freely rotate. Therefore, no driving force needs be given to the metal band plate at the forming portion, the occurrence of scars due to the rolling is suppressed and the hardening is caused less by the working, thus exhibiting a variety of effects.

It should be noted that the present invention can be modified in a variety of other ways without departing from the spirit and scope of the invention, and that the invention encompasses such modifications as a matter of course.

What is claimed is:

1. A method of forming a tube having a diameter from a metal band plate comprising the steps of:

lowering a pair of convex curved surface upper rollers having a radius onto a pair of V-shaped concave lower rollers, each of the pair of V-shaped concave lower rollers having a deepest portion of a concave portion, a predetermined distance to maintain a gap between the metal band plate and the deepest portion of the concave portion of the pair of V-shaped concave lower rollers, whereby when the metal band plate contacts each of the V-shaped concave lower rollers contact is made at two points and with each of the pair of convex curved surface rollers contact is made at a single point; and drawing the metal band plate through the pair of convex curved surface upper rollers and the pair of V-shaped concave lower rollers forming an arcuate curve on both ends of the metal band plate, whereby the diameter of the tube is modified by changing the predetermined distance between the upper and lower rollers.

2. A method as in claim 1 further comprising the step of:

positioning the plane of rotation of the lower roller at an acute angle to the planar surface of the metal band plate.

3. A method as in claim 1 further comprising the step of:

positioning the plane of rotation of the upper roller at an angle to the plane of rotation of the lower roller.

4. A method as in claim 2 further comprising the step of:

positioning the plane of rotation of the upper roller at an acute angle to the planar surface of the metal band plate.

5. A method of forming a tube from a metal band plate comprising the steps of:

moving a pair of convex curved surface rollers separated by a first distance into a concave portion having a deepest portion of a pair of concave V-shaped rollers a predetermined distance whereby when the metal band plate is placed therebetween each side portion of the metal band plate contacts the concave portion forming a gap between the metal band plate and the deepest portion;

feeding the metal band plate between the pair of convex curved surface rollers and the pair of V-shaped rollers whereby an arcuate shape is formed along the side portions of the metal band plate; and repeating the step of feeding a metal band plate with another pair of convex curved surface rollers and another pair of V-shaped rollers that are separated by a distance less than the first distance, whereby the tube is formed.

6. A method of breakdown-forming electro-unite tubes using breakdown pass rollers comprising in a step of breakdown-forming an electro-unite tube by arcuately forming both side portions of a metal band plate relying upon the breakdown pass rolls, each of said breakdown pass rolls includes an upper roll having a convex curved surface and a lower roll having a V-shaped concave portion opposed to said upper roll, and both side portions of the metal band plate are held between said upper rolls and said lower rolls and are formed into an arcuate shape.

7. A method of breakdown-forming electro-unite tubes according to claim 1, wherein said upper rolls and said lower rolls of the breakdown pass rolls are allowed to freely rotate, adjusting a distance between the end of a curved surface of said upper roll and the V-shaped concave portion of said lower roll, and arranging a pair of feed rolls in front of, or at the back of the breakdown pass rolls.

8. An apparatus for forming a tube from a metal band plate comprising:

a slide bar forming a first plane;

a screw bar coupling said slide bar together;

a first frame placed on one end of said slide bar;

a second frame placed on the other end of said slide bar, said first frame and said second frame separated by a first distance, whereby the first distance is adjustable;

a first convex curved surface upper roller having a first plane of rotation mounted within said first frame;

a second convex curved surface upper roller having a second plane of rotation mounted within said second frame;

a first V-shaped lower roller having a third plane of rotation and a concave portion with inclined surfaces ending at a deepest portion mounted within said first frame; and a second V-shaped lower roller having a fourth plane of rotation and a concave portion with inclined surfaces ending at a deepest portion mounted within said second frame, said first upper roller having an axial dimension to fit within the first V-shaped lower roller whereby when the metal band plate is positioned between said first upper roller and said first lower roller the metal band plate contacts the inclined surfaces at two points with a span therebetween and a gap is formed between the deepest portion and the metal band plate, said second upper roller having an axial dimension to fit within the second V-shaped lower roller whereby when the metal band plate is positioned between said second upper roller and said second lower roller the metal band plate contacts the inclined surfaces at two points with a span therebetween and a gap is formed between the deepest portion and the metal band plate, whereby the first distance and the gap can be adjusted to form a desired diameter tube and accommodate a desired thickness of metal band plate without changing rollers.

9. An apparatus for forming a tube from a metal band plate as in claim 8 wherein:

the third plane of rotation and the fourth plane of rotation form an acute angle with the planar surface of the metal band plate.

10. An apparatus for forming a tube from a metal band plate as in claim 8 wherein:

the first plane of rotation and the second plane of rotation form an acute angle with the planar surface of the metal band plate.

11. An apparatus for forming a tube from a metal band plate as in claim 8 wherein:

the first, second, third, and fourth planes of rotation form an acute angle with the planar surface of the metal band plate.

12. An apparatus for forming a tube from a metal band plate as in claim 8 wherein:

the first and second planes of rotation are perpendicular to the planar surface of the metal band plate; and the second and third planes of rotation form an acute angle with the planar surface of the metal band plate.

* * * * *